United States Patent [19]

Wright

[11] Patent Number: 5,007,857

[45] Date of Patent: Apr. 16, 1991

[54] ELECTRICAL RECEPTACLE WITH POWER INDICATOR LIGHT

[76] Inventor: Duane E. Wright, R.R. 1 - Box 33A, Maddock, N. Dak. 58348

[21] Appl. No.: 559,653

[22] Filed: Jul. 30, 1990

[51] Int. Cl.[5] ..... H01R 3/00

[52] U.S. Cl. ..... 439/490; 439/651

[58] Field of Search ..... 439/488–491, 439/650–655, 502–505

[56] References Cited

U.S. PATENT DOCUMENTS

| | | | |
|---|---|---|---|
| 2,640,184 | 5/1953 | Bauer | 439/655 |
| 3,201,617 | 8/1965 | Pacoroni | 439/651 |
| 3,509,356 | 4/1970 | Peebles | 439/652 |
| 4,850,897 | 7/1989 | Hard | 439/652 |
| 4,867,701 | 9/1989 | Wiand | 439/652 |

OTHER PUBLICATIONS

"LED's in Gasket Indicate Solenoid Power Status", Engineering Technology, Aro Corp., Machine Design, Apr. 1990, p. 46.

*Primary Examiner*—David L. Pirlot

*Attorney, Agent, or Firm*—Kinney & Lange

[57] ABSTRACT

An electrical receptacle configured for electrical connection with an electrical plug having a pair of contact blades. The receptacle includes a first pair of receptacle contacts configured for electrical connection with the pair of contact blades. A second pair of receptacle contacts, which are electrically insulated from the first pair of receptacle contacts, are configured for making electrical connection with the first pair of receptacle contacts through the pair of contact blades when the pair of contact blades are electrically connected to the first pair of receptacle contacts. A lamp is electrically connected in series between the second pair of receptacle contacts.

14 Claims, 1 Drawing Sheet

ELECTRICAL RECEPTACLE WITH POWER INDICATOR LIGHT

BACKGROUND OF THE INVENTION

This invention relates to an electrical receptacle for an electrical extension cord or an adaptor plug. In particular, this invention relates to a female type receptacle having a power indicator light.

A power indicator light provides a quick, easy visual verification of power delivery to a location remote from a power source. The light saves time and effort when attempting to pinpoint problems in electrical circuits. The power indicator light is particularly useful with an electrical extension cord for use at construction sites or at home on repair projects. The light indicates whether power is delivered through the extension cord to an attached power tool or appliance.

At construction sites, extension cords are often left plugged into the power source for extended periods of time. This leaves the cord exposed to damage caused by weather and various construction equipment. It is not uncommon to plug a power tool, such as a circular saw, into an extension cord and to find that the tool does not work. The user must then determine whether the power tool, extension cord or power source have malfunctioned or simply whether the extension cord is not plugged in. Many of these problems are reduced or eliminated by using an extension cord having a receptacle with a power indicator light. The power indicator light isolates these electrical problems between the attached power tool and the extension cord.

An example of a neon type voltage detector is disclosed by Cook in U.S. Pat. No. 3,234,464. The detector is a thin, detachable device for mounting on the prongs of a male plug. When the plug is inserted into a socket and the prongs contact live contacts within the socket, a neon bulb lights up indicating the presence of electrical power. Unfortunately, the detachable device is very susceptable to breakage and loss.

An example of a power indicator light housed within a female electrical receptacle of an electrical extension cord is disclosed by Grill in U.S. Pat. No. 4,671,597. The indicator light includes a resistor and a lamp connected in series between two terminals of the female receptacle. The lamp is in operation when power is delivered to the terminals through the extension cord. Extended operation, however, can cause the lamp to burn out. Therefore, this type of indicator light is not ideal for use at construction sites where extension cords are left plugged in for extended periods of time.

There is a continuing need for an improved power indicator light for use with an electrical extension cord. A long-life power indicator light that is relatively unsusceptible to breakage or loss is desired.

SUMMARY OF THE INVENTION

The present invention is an electrical receptacle having a power indicator light. The receptacle is configured for electrical connection with an electrical plug having a pair of contact blades. The receptacle includes a first pair of receptacle contacts adapted for electrical connection with the pair of contact blades. The power indicator light includes a lamp and a second pair of receptacle contacts, which are electrically insulated from the first pair of receptacle contacts. The second pair of receptacle contacts are adapted for making electrical connection with the first pair of receptacle contacts through the pair of contact blades when the pair of contact blades are electrically connected to the first pair of receptacle contacts. The lamp is electrically connected in series between the second pair of receptacle contacts.

In one embodiment, a molded housing member substantially encloses the first and second receptacle contacts and supports the lamp. The molded housing member partially encloses the lamp such that a portion of the lamp remains exposed for lamp visibility. The lamp preferably includes a neon bulb electrically connected in series between the second pair of receptacle contacts. The electrical receptacle may further include a receptacle grounding contact arranged with the first and second receptacle contacts to form a 3-wire female connector.

In one alternative embodiment, the receptacle and a male type plug are connected to opposite ends of an electrical cord to form an electrical extension cord. In another alternative embodiment, the electrical receptacle is configured to form an adaptor plug. In this embodiment, the electrical receptacle further includes a pair of adaptor blade contacts. The adaptor blade contacts are electrically connected to the first pair of receptacle contacts and extend from the molded housing member to form a male type plug. The receptacle may further include a receptacle grounding contact and a grounding prong which are arranged with the receptacle contacts and blade contacts to form a 3-wire adaptor plug.

The power indicator light in the receptacle of the present invention is both damage resistant and operable for extended periods of time. The molded housing member supports and protects the lamp within the electrical receptacle. Because the lamp can be illuminated only when the contact blades of an electrical plug are in contact with the first pair of receptacle contacts, the lamp has an extended life.

DETAILED DESCRIPTION OF THE PREFERRED EMBODIMENTS

Figure 1:
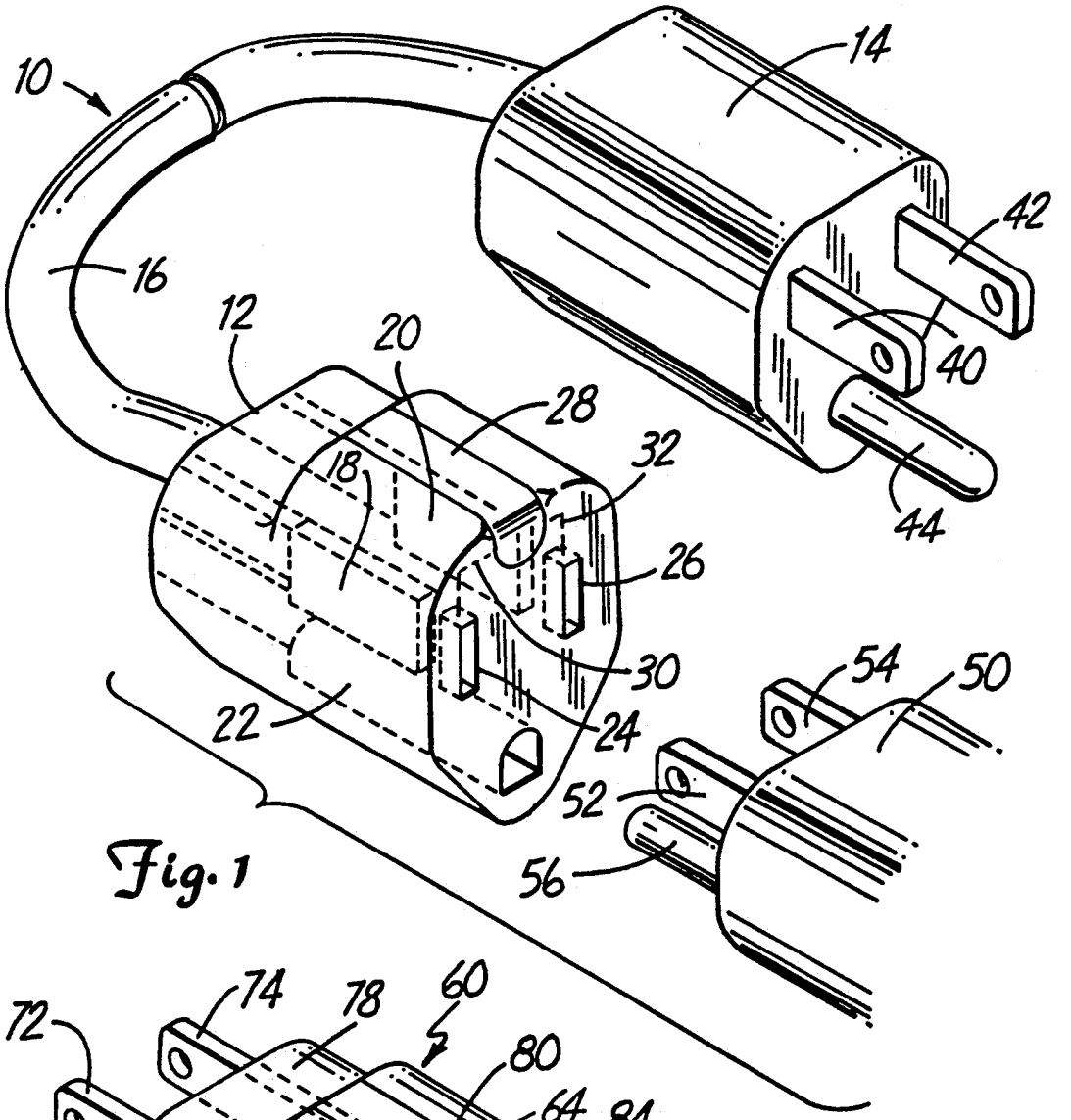
FIG. 1 is a perspective view of an electrical extension cord having a receptacle with a power indicator light in accordance with the present invention.

The present invention is an electrical receptacle having a power indicator light that is activated when power is applied to the receptacle and a male type plug is inserted into the receptacle. FIG. 1 is a perspective view of an electrical extension cord in accordance with the present invention. Extension cord 10 includes female type receptacle 12, male type plug 14 and electrical cable 16.

Female type receptacle 12 includes a first pair of receptacle contacts 18 and 20 (shown in phantom) and a receptacle grounding contact 22 (also shown in phantom) which are electrically connected to cable 16. Receptacle contacts 18 and 20 and grounding contact 22 are arranged to form a 3-wire female type connector. However, grounding contact 22 is optional. In an alternative embodiment (not shown) without grounding contact 22, receptacle contacts 18 and 20 form a 2-wire female type connector.

Receptacle 12 further includes a second pair of receptacle contacts 24 and 26 (shown in phantom) which are electrically insulated from the first pair of receptacle contacts 18 and 20. Lamp 28 is electrically connected in series between receptacle contacts 24 and 26 through leads 30 and 32 (shown in phantom). In a preferred embodiment, lamp 28 is a neon type lamp.

Housing 34 encases receptacle contacts 18, 20, 22, 24 and 26 and which partially encases lamp 28. A portion of lamp 28 remains exposed to provide lamp visibility. In the preferred embodiment, housing 34 is a molded member and lamp 28 is recessed slightly from the surface of the housing to protect the lamp from breakage or destructive contact. Housing 34 may comprise any polymer, shock resistant or non-conductive material.

Male type plug 14 includes contact blades 40 and 42 and grounding prong 44 which are electrically connected to cable 16. Contact blades 40 and 42 are electrically connected to receptacle contacts 18 and 20, respectively. Grounding prong 44 is electrically connected to receptacle grounding contact 22. Contact blades 40 and 42 and grounding prong 44 are configured for electrical connection with a female type receptacle coupled to a power source (not shown). When plug 14 is plugged into the power source, cable 16 delivers power to receptacle contacts, 18, 20 and 22.

Receptacle contacts 18, 20, 22, 24 and 26 are configured for electrical connection with a male type plug 50 of a power tool or appliance (not shown). Plug 50 includes contact blades 52 and 54 and grounding prong 56. When plug 50 is inserted into receptacle 12, contact blade 52 makes electrical connection with receptacle contacts 18 and 24, contact blade 54 makes electrical connection with receptacle contacts 20 and 26, and grounding prong 56 makes electrical connection with receptacle grounding contact 22. Receptacle contacts 24 and 26 make electrical connection with receptacle contacts 18 and 20 through contact blades 52 and 54, respectively. Current flowing from receptacle contact 24 to receptacle contact 26 through leads 30 and 32 and lamp 28 illuminates the lamp. The second pair of receptacle contacts 24 and 26 and lamp 28 form a power indicator light that illuminates only when power is applied to receptacle 12 and plug 50 is inserted into the receptacle.

Lamp 28 provides a visual indication of whether electrical power is present at receptacle 12. If a power tool does not operate after being plugged into receptacle 12, its user can determine instantaneously whether the power tool has malfunctioned or whether power is not available at receptacle 12. The power indicator light isolates electrical problems between the power tool and extension cord 10. Further, extension cord 10 may be left plugged in for extended periods of time without shortening the life of lamp 28. Lamp 28 is only illuminated when plug 14 is connected to an active power source and plug 50 is inserted into receptacle 12. With this configuration, extension cord 10 is ideal for use at construction sites where cords are often left plugged in for extended periods of time.

Figure 2:
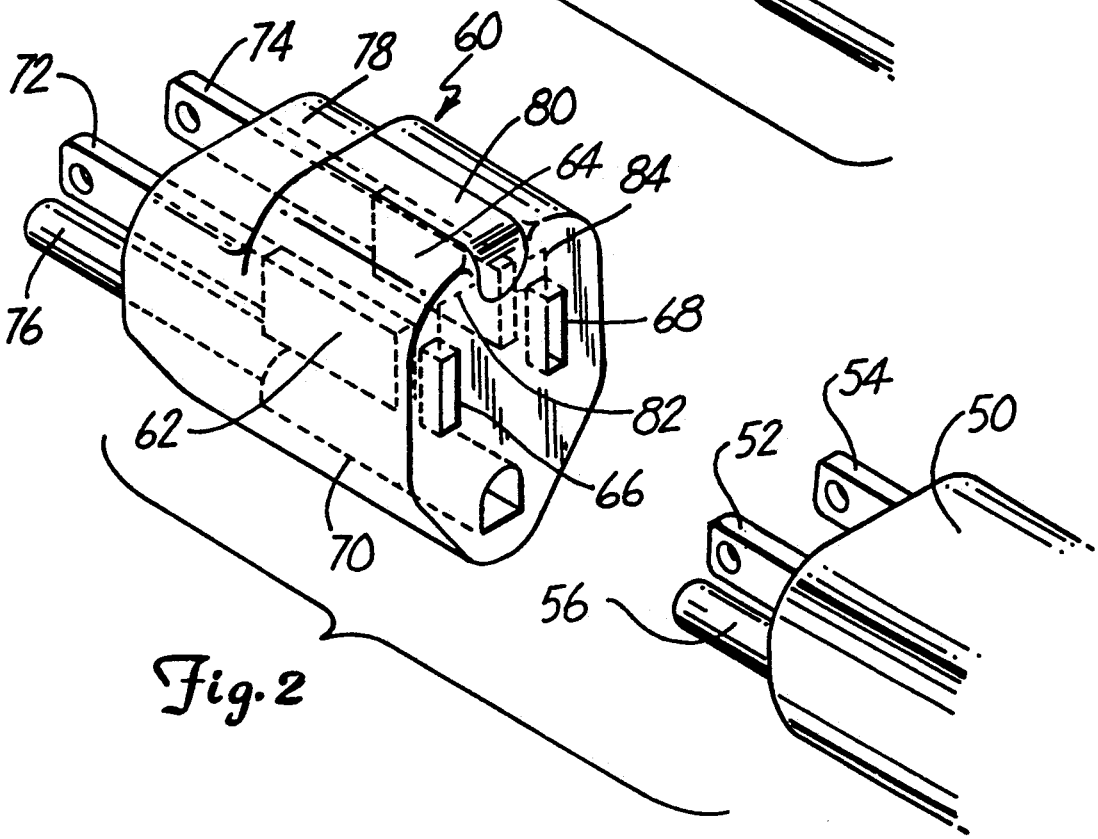
FIG. 2 is a perspective view of an adaptor plug having a receptacle with a power indicator light in accordance with the present invention.

In an alternative embodiment, the power indicator light of the present invention may be used in an adaptor plug which may be inserted into a conventional extension cord or wall outlet. FIG. 2 is a perspective view of an adaptor plug 60 in accordance with the present invention. Plug 60 includes a first pair of receptacle contacts 62 and 64 (shown in phantom), a second pair of receptacle contacts 66 and 68 (shown in phantom), receptacle grounding contact 70 (also shown in phantom), blade contacts 72 and 74 and grounding prong 76. Receptacle contacts 62 and 64 are electrically connected to contact blades 72 and 74, respectively. Receptacle grounding contact 70 is electrically connected to grounding prong 76. Receptacle contacts 62, 64 and 70 are configured to form a 3-wire female type electrical connector. Contact blades 72 and 74 and grounding prong 76 are configured to form a 3-wire male type electrical connector.

Molded housing member 78 encases receptacle contacts 62, 64, 66, 68 and 70 and partially encases lamp 80. Similar to the embodiment shown in FIG. 1, lamp 80 is electrically connected in series between receptacle contacts 66 and 68 through leads 82 and 84 (shown in phantom). Receptacle contacts 66 and 68 are electrically insulated from receptacle contacts 62 and 64 by molded housing member 78.

Male type plug 50 (shown in both FIGS. 1 and 2) can also be inserted into adaptor 60. Contact blades 52 and 54 of plug 50 electrically connect the second pair of receptacle contacts 66 and 68 and with the first pair of receptacle contacts 62 and 64, respectively when plug 50 is inserted into adaptor 60. Adaptor 60 may be inserted into a conventional extension cord or wall outlet to convert the cord or outlet into one having a power indicator light. Alternatively, adaptor 60 may be connected to plug 50 to convert plug 50 into a plug having a power indicator light in accordance with the present invention.

The present invention is an electrical receptacle having a long-life power indicator light that is relatively insensitive to damage and which may be conveniently secured to a conventional extension cord or wall outlet to prevent loss. The indicator light provides a quick visual indication of whether power is delivered to the receptacle from a connected power source.

Although the present invention has been described with reference to preferred embodiments, workers skilled in the art will recognize that changes may be made in form and detail without departing from the spirit and scope of the invention.

What is claimed is:

1. A unitary electrical receptacle configured for electrical connection with an electrical male plug having a pair of contact blades, the receptacle comprising:

a first pair of receptacle contacts configured for electrical connection with the pair of contact blades;

a second pair of receptacle contacts electrically insulated from the first pair of receptacle contacts and configured for making electrical connection with the first pair of receptacle contacts through the pair of contact blades when the pair of contact blades are electrically connected to the first pair of receptacle contacts; and a lamp electrically connected in series between the second pair of receptacle contacts and adapted for interconnection to the first pair of receptacle contacts when the male plug is inserted into the receptacle.

2. The electrical receptacle of claim 1 wherein the lamp comprises a neon bulb electrically connected in series between the second pair of receptacle contacts.

3. The electrical receptacle of claim 1 and further comprising a housing which substantially encloses the first and second receptacle contacts and supports the lamp.

4. The electrical receptacle of claim 3 wherein the housing comprises a molded member which encloses the first and second receptacle contacts and supports the lamp.

5. The electrical receptacle of claim 3 and further comprising an electrical cord electrically connected to the first pair of receptacle contacts and extending from the housing to form an electrical extension cord.

6. The electrical connector of claim 4 wherein the molded member partially encloses the lamp such that a portion of the lamp remains exposed to provide lamp visibility.

7. The electrical receptacle of claim 1 and further comprising a receptacle grounding contact.

8. The electrical receptacle of claim 7 wherein the first and second receptacle contacts and the receptacle grounding contact are arranged to form a 3-wire female connector.

9. The electrical receptacle of claim 3 and further comprising a pair of adaptor blade contacts electrically connected to the first pair of receptacle contacts and extending from the housing to form an adaptor plug.

10. The electrical receptacle of claim 9 and further comprising a receptacle grounding contact enclosed in the housing and an adaptor grounding prong electrically connected to the receptacle grounding contact and extending from the housing, the pair of adaptor blade contacts and the adaptor grounding contacts being ranged to form a 3-wire male adaptor plug.

11. An electrical extension cord comprising:

a first male type connector comprising a pair of protruding contact blades;

an electrical cable connected to the pair of contact blades; and a female type connector connected to the electrical cable and comprising:

a first pair of receptacle contacts electrically connected to the pair of contact blades through the electrical cable and adapted for making electrical connection with a pair of contact blades from a second male type connector;

a second pair of receptacle contacts electrically insulated from the first pair of receptacle contacts and adapted for making electrical connection with the first pair of receptacle contacts through the contact blades from the second male type connector when the pair of contact blades are electrically connected to the first pair of receptacle contacts;

a lamp electrically connected in series between the second pair of receptacle contacts; and a molded housing member which encases the first and second pair of receptacle contacts and partially encases the lamp such that a portion of the lamp remains exposed for lamp visibility.

12. The electrical extension cord of claim 11 wherein the first male type connector further comprises a protruding grounding prong electrically connected to the electrical cable and wherein the female type connector further comprises a receptacle grounding contact encased by the housing member and electrically connected to the grounding prong through the electrical cable.

13. An electrical adaptor plug comprising:

a molded housing member;

a first pair of male type contact blades extending from the housing member;

a first pair of female type receptacle contacts electrically connected to the first pair of male type contact blades and encased by the housing member;

a second pair of female type receptacle contacts encased by the housing member and electrically insulated from the first pair of female type receptacle contacts, the second pair of female type receptacle contacts configured for making electrical connection with the first pair of female type receptacle contacts through a second pair of male type contact blades when the contact blades are in electrical connection with the first female type receptacle contacts; and a lamp partially enclosed by the housing member and electrically connected in series between the second female type receptacle contacts.

14. The electrical adaptor plug of claim 13 and further comprising a male type grounding prong extending from the housing member and a female type grounding contact encased by the housing member and electrically connected to the grounding prong.

* * * * *